United States Patent [19]

Plumlee et al.

[11] 4,216,078

[45] Aug. 5, 1980

[54] HYDROGENATION OF PETROLEUM LIQUIDS USING QUINONE CATALYSTS

[75] Inventors: Karl W. Plumlee; Lonnie W. Vernon, both of Baytown, Tex.

[73] Assignee: Exxon Research & Engineering Co., Florham Park, N.J.

[21] Appl. No.: 686,828

[22] Filed: May 17, 1976

[51] Int. Cl.² ..... C10G 23/02

[52] U.S. Cl. ..... 208/143; 208/56; 208/264

[58] Field of Search ..... 208/56, 143, 264; 260/683.9

[56] References Cited

U.S. PATENT DOCUMENTS 3,700,583 10/1972 Salamony et al. ..... 208/8

3,840,456 10/1974 Yavorsky et al. ..... 208/10

*Primary Examiner*—Herbert Levine

*Attorney, Agent, or Firm*—L. A. Proctor; Wayne Hoover

[57] ABSTRACT

A process for hydrotreating a petroleum hydrocarbon feed comprising admixing a quinone compound, or compounds, with said hydrocarbon feed, and contacting said admixture with hydrogen at elevated temperature, suitably at temperatures ranging from about 500° F. to about 1050° F., preferably from about 750° F. to about 900° F. The petroleum hydrocarbon feed is characterized generally as comprised of a full boiling range crude, an atmospheric or vacuum residum, an unconventional whole heavy crude, or fractions boiling within the gasoline and mid-distillate ranges.

25 Claims, 2 Drawing Figures

HYDROGENATION OF PETROLEUM LIQUIDS USING QUINONE CATALYSTS

Petroleum hydrocarbons, e.g. petroleum crude oils, topped or reduced crude oils, as well as other hydrocarbon fractions and distillates, inclusive of heavy cycle stocks, vis-breaker liquid effluents, crude tower bottoms products, and residua, essentially always contain undesirable quantities of various non-metallic and metallic impurities that adversely effect the products (because of their intended use) or adversely effect downstream processes in which said hydrocarbon mixtures may be further processed as feeds. The non-metallic impurities include nitrogen, sulfur and oxygen which usually exist as heteroatomic compounds. Nitrogen, e.g., is particularly undesirable because it is a poison which is known to adversely effect many catalysts used in downstream processing, and both nitrogen and sulfur are objectionable, inter alia, because the oxides thereof can produce an acute pollution problem when released into the atmosphere. Sulfur, as relates to its presence in motor fuels, is particularly objectionable because of odor, gum and varnish formation, and it significantly decreases lead susceptibility.

Petroleum distillates, in particular, contain appreciable quantities of unsaturated hydrocarbons, including both mono-olefinic and di-olefinic straight and/or branched chain hydrocarbons, and aromatics, including compounds such as styrene, isoprene, dicyclopentadiene, and the like. Such components contained in a naphtha fraction, intended for use as a motor fuel, motor fuel blending component, or as a charge stock to a catalytic reforming unit, are thus contaminants. Similarly, the presence of high-boiling unsaturated hydrocarbons in a charge stock intended for conversion into lower-boiling hydrocarbons, is contaminated because of the propensity thereof to polymerize and/or copolymerize whereby a more refractory material, one much less susceptible to conversion, and more prone to deactivate a catalyst, is formed. In many instances, mono- and polynuclear aromatic hydrocarbons are contaminants with respect to a charge stock intended for a cracking process, since the higher the concentration of aromatic hydrocarbons, the more refractory the charge stock, and the higher the required severity of operation. High severity operations, which are essential in effectively removing nitrogen and sulfur, thus often result in the excessive production of coke and carbonaceous materials, as well as excessive quantities of waste gases including light paraffinic hydrocarbons. Similarly, fuel oils containing excessive quantities of aromatic hydrocarbons exhibit poor burning qualities and a low smoke point whereby the products of combustion have a greater tendency to cause severe atmospheric pollution.

A primary objective of the present invention is to provide a new and novel process for hydrotreating petroleum feeds or feedstocks utilizing molecular hydrogen or a hydrogen donor diluent, or both, as a hydrogen source.

A particular object is to provide a new and more efficient process for the treatment with hydrogen of a wide range of petroleum hydrocarbon fuels, particularly one suitable for effecting hydrogenation, and the hydrodesulfurization or hydrodenitrogenation, or both, of a wide range of such feeds.

A more particular object is to provide a process of such character for improving the general quality of a wide boiling range of petroleum hydrocarbon feeds by removing various deleterious or undesirable constituents, such as sulfur, nitrogen, oxygen, odor and gum forming constituents and the like.

These objects and others are achieved in accordance with the present invention constituting a process for hydrotreating a petroleum hydrocarbon feed comprising admixing a quinone compound, or compounds, with said petroleum hydrocarbon feed, and contacting said admixture with hydrogen at elevated temperature, suitably at temperatures ranging from about 500° F. to about 1050° F., preferably at from about 750° F. to about 900° F. Suitably, the hydrogen is employed as molecular hydrogen, or as a hydrogen donor diluent admixed with the petroleum hydrocarbon feed, or both. In such process, pressures generally range from about 300 to about 3000 psig, preferably from about 1000 to about 2000 psig. Hydrogen is generally introduced at a rate of from about 500 to about 10,000 SCF/Bbl, preferably at from about 1000 to about 6000 SCF/Bbl. The hydrogen generally is introduced at velocities ranging from about 0.1 to about 10 SLHV, preferably at velocities ranging from about 0.2 to about 2 SLHV.

In conducting the reaction the petroleum feed, if desired, can be admixed with a hydrocarbon solvent. This may be particularly desirable, for example, when an unconventional whole heavy crude containing large amounts of 1050° F.+ materials, sand, scale, high metals and con carbon content and the like, or residua, is to be processed. Such unconventional whole heavy crudes are further defined, or characterized in terms of their orgin and properties in, e.g., U.S. Pat. Nos. 3,993,598; 3,993,601; 3,989,645; 3,985,684; 3,977,961-2. Suitably, such solvent is one boiling within a range of from about 200° F. to about 1000° F., but preferably from about 400° F. to about 700° F. Solvent is generally added to the petroleum feed in amounts ranging from about 0 to about 80 percent, preferably from about 0 to about 40 percent, based on the weight of the petroleum hydrocarbon feed. A feature of this invention is that the petroleum feed can be processed by contact with molecular hydrogen, there being no necessity to employ a solvent which contains hydrogen donor compounds, or hydrogen donor diluent. In some instances, however, it may be desirable to supply all or some part of the required hydrogen by use of a hydrogen donor diluent. Solvents useful for the practice of this invention, defined in terms of hydrogen donor potential, are (1) non-donor solvents, or solvents which contain less than 0.8 percent donatable hydrogen, based on the weight of solvent, and (2) donor solvents, or solvents which contain at least 0.8 percent, and preferably from about 1.2 to about 3 percent, and greater, of donatable hydrogen, based on the weight of solvent. Donor solvents generally contain about 30 percent, and most often about 50 percent, of an admixture of hydrogen donor compounds, adequate to supply the necessary hydrogen at reaction conditions, based on the total weight of solvent. Where such amounts of hydrogen donor compounds are not present ab initio in a given solvent vehicle, additional amounts of these materials can be added. Preferred hydrogen donor compounds added to, or originally contained within a suitable solvent donor vehicle, include indane, dihydronaphthalene, $C_{10}$–$C_{12}$ tetrahydronaphthalenes, hexahydrofluorine, the dihydro-, tetrahydro-, hexahydro-, and octahydrophenanthrenes, $C_{12}$–$C_{13}$ acenaphthenes, the tetrahydro-, hexahydro- and decahydropyrenes, the dihydro-, tetrahydro-, hexanhydro-, and octahydro-anthracenes, and other derivatives of partially saturated aromatic compounds.

A quinone compound, or mixture of quinone compounds, is dispersed or dissolved within the feed or feedstock that is to be hydrogenated, the quinone effectively catalyzing the hydrogenation reaction. The quinone is a cyclic compound characterized by the presence of the quinoid structure or system wherein two keto or hydroxy groups are connected by a system of conjugated double bonds. It is a mono- or polycyclic hydrocarbon compound which contains two oxygen atoms or hydroxyl groups which occupy either ortho or para positions are oxygen atom or hydroxyl group relative to the other. Where the quinone is polycyclic, the rings constituting the nucleus of the molecule can be fused or non-fused, or it can contain both fused and non-fused rings. The quinone generally contains from 1 to about 6 rings in the total molecule, and preferably from 1 to about 3 rings, with 1 or 2 rings being most preferred. The rings can be substituted or unsubstituted, and in terms of carbon atoms the total molecule can contain from 6 to about 36 carbon atoms, preferably from 6 to about 14 carbon atoms. Sterically unhindered molecules are preferable and, therefore, where substitution is present large branched substitutent chains, and highly polar groups are generally to be avoided. The oxygen atoms of the carboxy or hydroxy groups while occupying portions ortho or para one to the other can be on the same ring, or can be located on different rings. Polynuclear polyquinones, particularly diquinones are also satisfactory. Exemplary of quinone compounds suitable for the practice of this invention are such species as o-benzoquinone, p-benzoquinone, 2,5-dichloro-p-benzoquinone, tetrachloro-p-benzoquinone, 1,2-naphthoquinone, 1,4-naphthoquinone, 2-methyl-1,4-naphthoquinone, 2,6-naphthoquinone, 1,2-anthraquinone, 1,4-anthraquinone, 9,10-anthraquinone, 1,7-anthraquinone, phenanthrene quinone, acenaphthene quinone, chrysene quinone, 4,4'-diphenoquinone, 2,2'-dephenoquinone, 4,4'-stilbenequinone, 1,2,3,4-naphthodiquinone, 1,4,5,8-naphthodiquinone and the like. The ortho quinones are a preferred species, as contrasted with the para quinones.

In one of its aspects, a full boiling range crude having an initial boiling point ranging from about 50° F. to about 400° F., and more suitably from about 120° F. to about 200° F., and a final boiling point ranging from about 950° F. to about 1050° F.+, more suitably from about 1000° F. to about 1050° F.+, or an atmospheric or vacuum residuum, or unconventional whole heavy crude, having a final boiling point ranging from about 950° F. to about 1050° F.+, more suitably from about 1000° F. to about 1050° F.+ can be hydrotreated by admixing a quinone compound or admixture of quinone compounds, to effectively hydrodesulfurize and hydrogenate such feeds. Such crudes can contain 1050° F.+ material ranging from about 1 to about 60 percent, generally from about 5 to about 40 percent, and more generally from about 10 to about 30 percent.

In another of its aspects, the present invention relates to a process for hydrotreating a feed boiling within the gasoline range, i.e., a liquid petroleum hydrocarbon boiling at a temperature ranging from about 100° F. to about 400° F., or about 450° F., which hydrocarbons are generally employed as motor fuels. Motor fuels thus generally contains some normal- and iso-butanes, and normal- and iso-pentanes, but more characteristically are $C_5$+ hydrocarbons. In the treatment of the $C_5$—450° F. hydrocarbon fraction, the $C_5$—450° F. fraction with the admixed quinone, or admixture of quinones, is contacted with hydrogen at temperatures ranging from about 500° F. to about 1050° F., preferably at temperature ranging from about 750° F. to about 900° F. to convert nitrogenous and sulfurous compounds to ammonia and hydrogen sulfide, respectively, and to hydrogenate and saturate previously unsaturated mono- and polyolefinic compounds.

In yet another of it aspects, the present invention relates to a process for hydrotreating a feed boiling in the mid-distillate, or kerosene or gas oil range. Such hydrocarbon fractions generally have an initial boiling point ranging from about 300° F. to about 450° F. and an end boiling point ranging from about 550° F. to about 650° F., where such products are to be used as fuel oils, kerosene, jet fuels and the like. Where such fuels are to be used as a refinery, feedstock, i.e., hydrocrackate, or charge to a catalytic cracker, or as a diesel oil, distillate fuel, or the like, the end boiling point ranges generally from about 800° F. to about 950° F. By hydrotreating such feeds at temperatures ranging from about 500° F. to about 1050° F., and preferably from about 750° F. to about 900° F., hydrodesulfurization and hydrogenation of unsaturates are usually readily accomplished, and some hydrodenitrogenation is usually obtained.

In these several embodiments, the quinone compound is added to the petroleum hydrocarbon feed in concentration ranging from about 0.01 to about 5 percent, and preferably from about 0.1 to about 2 percent, based on the weight of the feed.

The reason for the effectiveness of a quinone compound in catalyzing the hydrogenation reaction, while not completely understood, is predicated on a sound theoretical basis. Such discovery is quite surprising, albeit it is known that quinones have been admixed with a hydrogen donor solvent wherein coal, slurried therewith, is hydrogenated and liquified in the presence of added molecular hydrogen, as disclosed in U.S. Pat. No. 3,700,583 to Salamony et al. (1972). It is disclosed in the Salamony et al. process that the quinones act, not as catalysts but as carbon-radical scavengers which are consumed in the process of healing the reactive ends of broken free radical moities to prevent their recombination which forms high molecular weight polymers and char.

It was heretofore known that quinones are oxidizing agents, that a quinone, Q, could be catalytically hydrogenated and converted to a hydroquinone, $QH_2$, and from electrochemical studies it was even known that the hydrogenation of a quinone, to use p-benzoquinone as illustrative, could proceed in a reversible stepwise two electron reduction fashion, (from quinone, Q, to semiquinone, $QH^{\bullet}$, to hydroquinone ($QH_2$)), to wit:

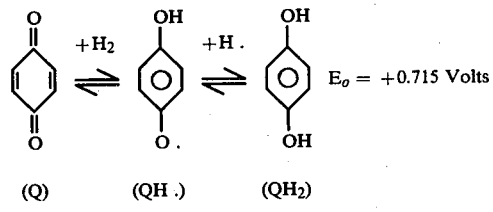

Quinones, as known from various organic reactions, are capable of abstracting hydrogen from saturates (R) and hydroaromatics (A), pursuant to the following reactions $$R+Q \rightleftarrows R^{=}+QH_2$$

$$H_2A+Q \rightleftarrows A+QH_2$$

to form unsaturates ($R^{=}$) and aromatics (A). In accordance with the theory of Salamony et al, quinone, in its action as a carbon-radical scavenger would be expected to procede as follows: Coal would break down into free radical moities, to wit:

$$\text{Coal} \xrightarrow{\Delta} R^{\bullet}$$

The quinone, Q, would then react with the free radical, $R^{\bullet}$, as follows:

$$R^{\bullet}+Q \rightarrow RH+Q^{\bullet} \quad (1)$$

or polymerize with free radicals to give $$R^{\bullet}+Q \rightarrow QOR+Q(OR)_2 \quad (2)$$

or $$R^{\bullet}+Q \rightarrow RQ^{\bullet}$$

there Q· and RQ· are polymer precursors and QOR and $Q(OR)_2$ are polymers. Applicants have established, however, that quinones can act as a true catalyst at hydrogenation conditions, a reversible equilibrium between the quinone structure and the hydroquinone structure being established such that the quinone is readily hydrogenated by molecular hydrogen, and the hydrogen is readily conveyed from the hydroquinone to a hydrogen deficient site on a reactant molecule, to wit:

$$Q \xrightarrow{+H_2} QH^{\bullet} \xrightarrow{+H^{\bullet}} QH_2$$

$$R^{\bullet}+QH_2 \rightarrow QH^{\bullet}+RH$$

$$QH^{\bullet}+R^{\bullet} \rightarrow Q+RH$$

At these severe conditions quinones can also serve to catalyze the hydrogenation of aromatic molecules, to wit:

$$A+H_2 \xrightarrow{Q} AH_2$$

Referring to the attached figures.

Figure 1:
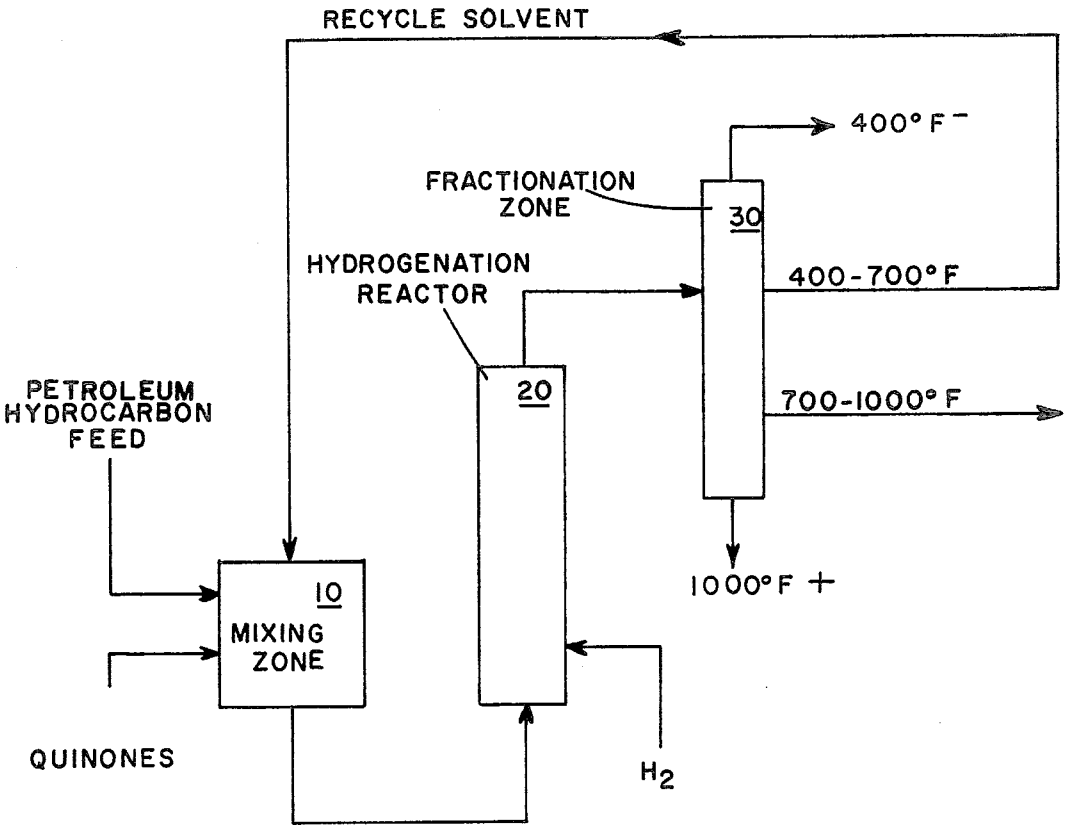
FIG. 1 is a schematic flow diagram of a process, generally suitable for the practice of the present invention.

In accordance with the best mode of practicing the present invention, generally illustrated in schematic fashion by reference to FIG. 1 (a) the quinone, or admixture thereof, is added to the petroleum hydrocarbon feed to be processed in a vessel, or mixing zone 10 at ambient conditions. A solvent, or slurry oil, fresh or recycle, in addition to the feed, can be added, if desired. (b) The quinone oil slurry mixture is then fed with hydrogen, upflow or downflow, generally upflow, into a reactor, or reaction zone 20 at elevated temperature. (c) Effluent from the top of reactor 20 is passed into a fractionation column 30 and split, suitably into a multiplicity of fractions, one of which can be recycled if desired as a solvent.

These conditions are more specifically described, as follows:

(a) In the mixing zone 10, the quinone compound is added to the feed in concentrations ranging from about 0.01 to about 5 weight percent, preferably from about 0.1 to about 2 weight percent. Where a highly viscous feed is to be processed, a slurry oil or solvent can be added, if desired. Suitably, a slurry oil or suitable recycle solvent is added in a ratio of solvent: feed ranging from about 0.5:1 to about 2:1, based on weight. The slurry oil or solvent to which the quinone compound is added is generally one which boils within the range of about 200° F. to about 1000° F., preferably from about 400° F. to about 700° F. The feed and slurry in admixture with the quinone compound is fed with molecular hydrogen, into the reaction zone 20.

(b) Within reaction zone 20, temperatures ranging generally from about 500° F. to about 1050° F., preferably from about 750° F. to about 900° F., with pressures ranging from about 300 psig to about 3000 psig, preferably from about 1000 psig to about 2000 psig are maintained. Molecular hydrogen is added to the reaction zone 20 at a rate of from about 500 to about 10,000 SCF/Bbl, preferably from about 1000 to about 6000 SCF/Bbl, at rates ranging from about 0.1 to about 10 SLHV, preferably from about 0.2 to about 2 SLHV.

(c) The effluent from reaction zone 20 consisting of a reaction product mixture of gases and liquids, the liquids comprising a mixture of slurry oil or solvent, a quinone compound, or compounds, and heavier ends, is transferred into a separation zone or fractionation column 30 wherein light boiling fractions, intermediate boiling fractions and heavy boiling fractions can be recovered as desired. Any suitable solvent fraction, e.g., fractions boiling from about 400° F. to 700° F. can be recovered, and a portion thereof recycled, as desired.

These and other features of the present process will be better understood by reference to the following demonstrations and examples obtained in accordance with this invention. All units are in terms of weight unless otherwise specified.

The following demonstration and examples are illustrative of the effectiveness of various quinone compounds in hydrogenating chemically pure naphthalene to hydroaromatics, the various quinone compounds being compared with a run conducted at similar conditions, except that no quinone was employed.

EXAMPLES 1-6

In conducting the series of runs 2.1 gram portions of feed constituted of 5 weight percent quinone catalyst mixed with naphthalene were charged into stainless steel tubing bombs of 30 cc internal volume. The bombs were charged with 500 psig molecular hydrogen gas at room temperature, sealed, and submerged horizontally in a constant temperature sandbath to provide the desired reaction temperature. During the runs the bombs were agitated at 120 cycles per minute for 130 minutes in the fluidized sandbath while heated sufficiently to provide a temperature of 840° F., and a total pressure of 1500 psig. The products were analyzed to determine the weight of hydrogen consumed based on the weight of available hydrogen, with the results shown in the following Table 1.

Table 1

| Catalyst | Wt. % $H_2$ Consumed |
|---|---|
| None | 4% |

Table 1-continued

| Catalyst | Wt. % $H_2$ Consumed |
|---|---|
| 9,10 anthraquinone | 10% |
| p-benzoquinone | 15% |
| p-hydroquinone | 26% |
| tetrachloro-p-benzoquinone | 26% |
| p-quinhydrone | 31% |
| o-hydroquinone | 47% |

EXAMPLES 7-8

In additional runs identical to the foregoing, except that the catalyst concentration was varied, data obtained using 10%, 5% and 0.5% p-benzoquinone by weight on naphthalene show that hydrogen consumption in each instance is again 15%, based on available hydrogen. This clearly establishes that, over this range of concentration, hydrogen consumption is independent of catalyst concentration.

EXAMPLES 9-14

Another series of the bombs, as used in the foregoing examples, were each charged with 3 gram portions of a West Texas Atmospheric Residuum, to all but one of which 5 weight percent of various quinones were added, all were charged with 500 psig or molecular hydrogen gas at ambient temperature and the runs again conducted at 840° F., 1500 psig at a reaction time of 130 minutes and 60 minutes, respectively, to hydrogenate the feed.

The inspection on the West Texas Atmospheric Residuum is as follows:

| Feedstock Inspections | |
|---|---|
| API Gravity | 20.1 |
| Sulfur, Wt. % | 2.0 |
| Nitrogen, Wt. % | — |
| Carbon, Wt. % | 85.72 |
| Hydrogen, Wt. % | 11.77 |
| Oxygen, Wt. % | — |
| Conradson Carbon, Wt. % | 5.6 |
| cc 10% BT | — |
| Metals, ppm | |
| Ni | 10 |
| V | 24 |
| Fe | 8 |

The quality of the products obtained from these runs, using various quinones, are given in the following Table 2.

Table 2

| Catalyst | % Yield on Feed Gas | Liquid | Solid | Reaction Time | % De-Sulfurization |
|---|---|---|---|---|---|
| None | 15.3 | 68.1 | 17.2 | 130 Min. | 38 |
| | 6.0 | 81.1 | 12.9 | 60 Min. | 27 |
| Chloranil | 13.8 | 73.5 | 12.6 | 130 Min. | 52 |
| | 9.6 | 78.4 | 11.9 | 60 Min. | 49 |
| 9, 10 anthraquinone | 13.5 | 75.8 | 10.8 | 130 Min. | 45 |
| p-hydroquinone | 9.5 | 83.4 | 7.3 | 130 Min. | 46 |
| p-benzoquinone | 8.5 | 83.8 | 7.7 | 130 Min. | 53 |
| | 7.6 | 86.1 | 6.3 | 60 Min. | 31 |
| pyro catechol | 8.1 | 90.8 | 1.0 | 130 Min. | 43 |
| | 7.2 | 91.2 | 1.7 | 60 Min. | 34 |

Figure 2:
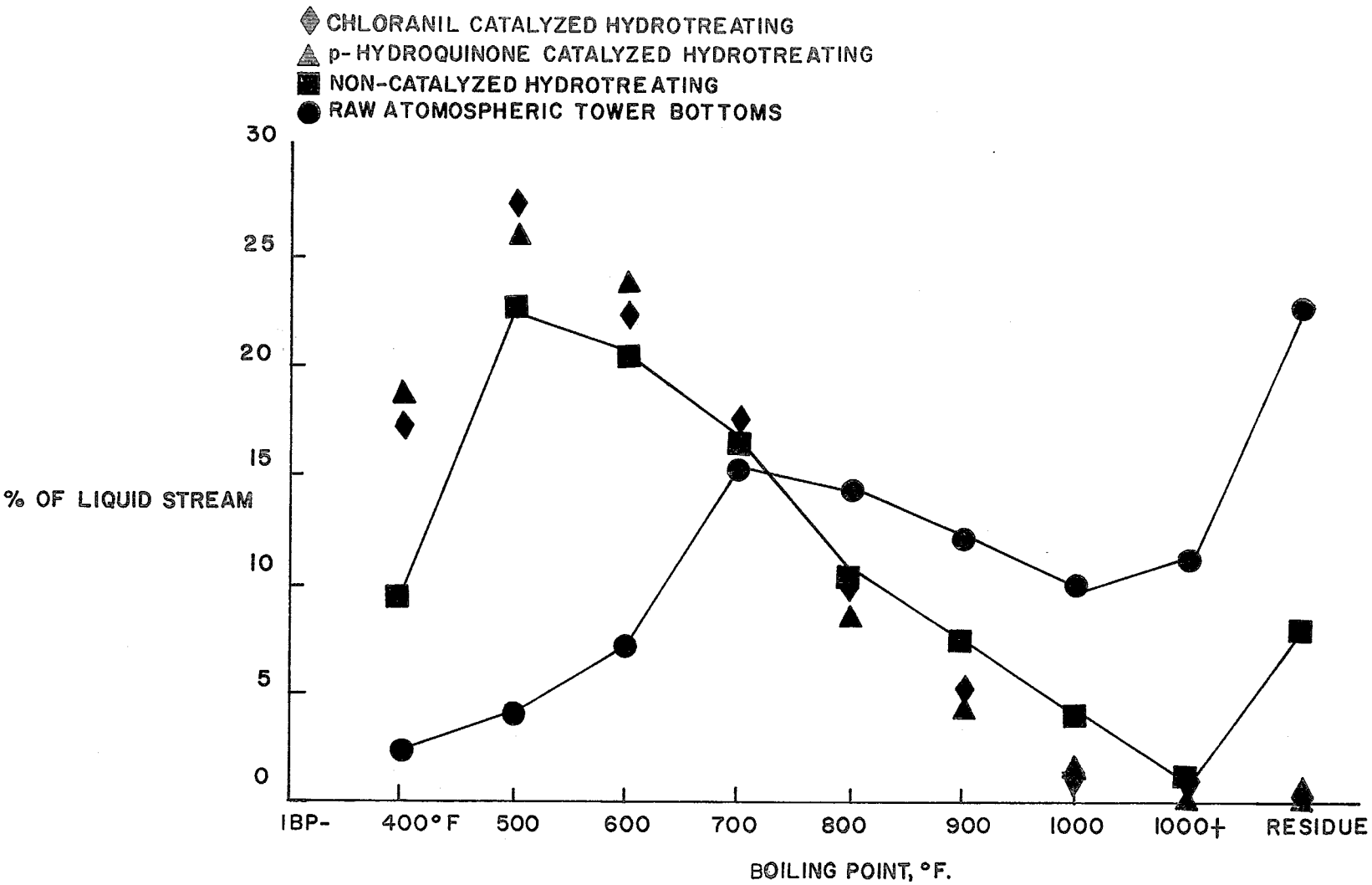
FIG. 2 is a graphic illustration which compares the boiling point distributions of products with a feed from which the products were obtained.

Products of the chloranil and p-hydroquinone hydrotreatment were further analyzed on the basis of boiling point, °F. as a percent of total liquid, and these analyses were compared with the hydrogenation run wherein no quinone was added, and with the raw crude. The results, which show a definite shift toward lower molecular weight products for the catalyst feeds, are graphically illustrated in the attached FIG. 2.

It is apparent that various modifications can be made in the process without departing the spirit and scope of the present invention.

Having described the invention, what is claimed is:

1. A process for hydrotreating a petroleum hydrocarbon feed comprising admixing with said hydrocarbon feed an added quinone compound, and hydrogenating said admixture at temperature ranging from about 500° F. to about 1050° F.

2. The process of claim 1 wherein the process is operated at a temperature ranging from about 750° F. to about 900° F.

3. The process of claim 1 wherein the quinone compound is added to the feed in concentration ranging from about 0.01 to about 5 percent, based on the weight of this feed.

4. The process of claim 3 wherein the concentration of the quinone compound ranges from about 0.1 to about 2 percent.

5. The process of claim 1 wherein the petroleum hydrocarbon feed is characterized as a full boiling range crude, an atmospheric or vacuum residuum, an unconventional whole heavy crude, or fractions boiling within the gasoline and mid-distillate ranges.

6. The process of claim 1 wherein the petroleum hydrocarbon feed is admixed with from about 0 to about 80 percent, based on the weight of the feed, of a solvent.

7. The process of claim 6 wherein the solvent is a hydrogen donor solvent.

8. The process of claim 6 wherein the solvent is a non-donor solvent, and molecular hydrogen is used to effect the hydrogenation.

9. The process of claim 1 wherein the hydrogenation is conducted by contacting said petroleum hydrocarbon feed with molecular hydrogen.

10. The process of claim 1 wherein the hydrogenation is conducted by contacting said petroleum hydrocarbon feed with a hydrogen donor solvent and molecular hydrogen.

11. A process for hydrogenating a petroleum hydrocarbon feed to produce lower boiling liquid products, which comprises: (a) contacting in a hydrogenation zone, in the presence of an added quinone compound, said feed with a hydrogen donor solvent at temperature and pressure sufficient to convert the feed to a lower boiling liquid product, (b) separating the product from the hydrogenation zone into fractions inclusive of a liquid solvent fraction which contains at least 30 weight percent hydrogen donor compounds, (c) recycling the hydrogenated liquid solvent mixture to said hydrogenation zone, without hydrogenation of said liquid solvent mixture prior to recycle, and (d) recovering the lower boiling liquid product.

12. The process of claim 11 wherein the liquid solvent fraction contains at least 50 percent hydrogen donor compounds.

13. The process of claim 11 wherein the liquid solvent is added to the petroleum feed in amounts ranging to about 80 percent, based on the weight of the petroleum feed.

14. The process of claim 11 wherein the liquid solvent is one boiling within about a 200° F. to 1000° F. range.

15. The process of claim 11 wherein the liquid solvent is one boiling within the 400° F. to 700° F. range.

16. The process of claim 11 wherein the quinone compound is added to the hydrogenation zone in concentration ranging from about 0.01 to about 5 percent, based on the weight of the feed.

17. The process of claim 16 wherein the quinone compound is an ortho-quinone.

18. The process of claim 11 wherein molecular hydrogen is additionally added to the hydrogenation zone.

19. A process for hydrogenating a petroleum hydrocarbon feed to produce lower boiling liquid products, which comprises: (a) admixing said petroleum hydrocarbon feed, a non-donor solvent, and a quinone compound, or admixture of quinone compounds, (b) contacting said admixture with molecular hydrogen in a hydrogenation zone at temperature and pressure sufficient to hydrogenate and convert the petroleum hydrocarbon feed to a lower boiling liquid product, (c) separating the admixture into fractions, inclusive of a liquid non-donor solvent fraction, (d) recovering the lower boiling liquid product, and (e) recycling said liquid non-donor solvent fraction to said hydrogenation zone.

20. The process of claim 19 wherein the temperature of hydrogenation ranges from about 500° F. to about 1050° F.

21. The process of claim 20 wherein the temperature ranges from about 750° F. to about 900° F.

22. The process of claim 19 wherein the pressure of the hydrogenation ranges from about 300 psig to about 3000 psig.

23. The process of claim 22 wherein the pressure ranges from about 1000 psig to about 2000 psig.

24. The process of claim 19 wherein said solvent is one boiling within a range of from about 200° F. to about 1000° F.

25. The process of claim 24 wherein said solvent is one which boils within a range from about 400° F. to about 700° F.

* * * * *